US005842875A

United States Patent [19]

Yagi

[11] Patent Number: 5,842,875

[45] Date of Patent: Dec. 1, 1998

[54] ELECTRIC CONNECTOR ASSEMBLY FOR USE IN COUPLING TWO PRINTED BOARDS

[75] Inventor: Masanori Yagi, Sagamihara, Japan

[73] Assignee: Molex Incorporated, Lisle, Ill.

[21] Appl. No.: 778,989

[22] Filed: Jan. 6, 1997

Related U.S. Application Data

[63] Continuation of Ser. No. 341,260, Nov. 17, 1994, Pat. No. 5,641,290, and a continuation of Ser. No. 644,294, May 10, 1996, Pat. No. 5,639,248.

[30] Foreign Application Priority Data

Dec. 14, 1993 [JP] Japan ..... 5-72211

[51] Int. Cl.[6] ..... H01R 9/09

[52] U.S. Cl. ..... 439/74

[58] Field of Search ..... 439/74, 65, 66, 439/83, 660, 876

[56] References Cited

U.S. PATENT DOCUMENTS

| | | | |
|---|---|---|---|
| 4,113,179 | 9/1978 | McKee | 339/91 R |
| 4,734,060 | 3/1988 | Kawawada et al. | 439/660 |
| 5,007,844 | 4/1991 | Mason et al. | 439/68 |
| 5,074,039 | 12/1991 | Hillbish et a l. | 29/883 |
| 5,161,985 | 11/1992 | Ramsey | 439/74 |
| 5,167,528 | 12/1992 | Nishiyama et al. | 439/489 |
| 5,176,541 | 1/1993 | Mori | 439/736 |
| 5,181,855 | 1/1993 | Mosquera et al. | 439/74 |
| 5,192,232 | 3/1993 | Lenz et al. | 439/660 |
| 5,199,884 | 4/1993 | Kaufman et al. | 439/74 |
| 5,201,883 | 4/1993 | Atoh et al. | 29/883 |
| 5,203,710 | 4/1993 | Miyazawa | 439/71 |
| 5,224,866 | 7/1993 | Nakamura et al. | 439/81 |
| 5,277,597 | 1/1994 | Masami et al. | 439/83 |
| 5,310,357 | 5/1994 | Olson | 439/346 |
| 5,499,924 | 3/1996 | Arisaka et al. | 439/74 |
| 5,535,513 | 7/1996 | Frantz | 29/882 |

FOREIGN PATENT DOCUMENTS

| | | | |
|---|---|---|---|
| 6-310197 | 11/1994 | Japan | H01R 9/09 |
| 6-325825 | 11/1994 | Japan | H01R 13/631 |
| 6-215837 | 8/1995 | Japan | H01R 23/68 |

*Primary Examiner*—Kheim Nguyen
*Assistant Examiner*—Yong Ki Kim
*Attorney, Agent, or Firm*—James C. Paschall

[57] ABSTRACT

Disclosed is an improved electric connector assembly for use in coupling two printed boards. The height of such assembly is reduced yet a good effective length of contact beam and increased distance between the soldering tails of the opposite terminals is assured. Each female terminal is composed of a horizontal base, a contact beam rising from one end of the horizontal base and having contact near its top end. A transition descends from the other end of the horizontal base, and a soldering tail horizontally extends from the transition. The female terminals are attached to opposite side walls of their housing with their horizontal bases partly embedded in the opposite side walls.

25 Claims, 10 Drawing Sheets

ELECTRIC CONNECTOR ASSEMBLY FOR USE IN COUPLING TWO PRINTED BOARDS

This is a continuation of application Ser. No. 08/341,260 filed on Nov. 17, 1994, now U.S. Pat. No. 5,641,290 and Ser. No. 08/644,294 filed on May 10, 1996, now U.S. Pat. No. 5,639,248.

FIELD OF THE INVENTION

The present invention relates to an electric connector assembly for use in coupling two printed boards.

DESCRIPTION OF THE PRIOR ART

Electric connector assemblies having a male part and a female part are used in coupling two printed boards. Electric connection can be made between the electric circuits of two printed boards by mating the male part attached to one of the two boards with the female part attached to the other boards. There has been an increasing demand for electric connectors of reduced height.

Japanese Patent Application Public Disclosure No. 5-144498 discloses such an electric connector assembly of reduced height. As seen from FIG. 19 herein, its female part has a pair of female terminals 2' arranged in opposite relationship and fitted in its housing. Each female terminal is composed of a vertical base section 3', a soldering tail 6' horizontally extending from one end of the vertical base section 3' and a contact 5' rising up from the other end of the vertical base section 3'. The opposite female terminals 2' are embedded by their base sections 3' in the floor 4' of the housing 1' of the female part, allowing their soldering tails 6' to lie under the bottom 7' of the housing 1', and at the same time, allowing their contacts 5' to remain in the terminal accommodating space in the housing 1'. As seen from the drawing, there are no recesses made in the bottom 7' of the housing 1' particularly in the vicinities of the transient parts from the soldering tails 6' to the vertical base section 3' of the opposite female terminals 2'.

The male part of the conventional electric connector has a pair of male terminals 10' arranged in opposite relationship and fitted in the housing 9'. Each male terminal 10' is composed of a vertical contact section, a soldering tail 13' horizontally extending from one end of the vertical contact section, a slanted transient section extending from the other end of the vertical contact section, and a vertical holding section 11' extending from the slanted transient section. The vertical holding section 11' of the opposite male terminals 10' are press fitted in the opposite slots 12' of the center leg of the housing 9' of the male part, allowing the soldering tails 13' to be extended laterally outward.

The prior art electric connector has following defects: (1) as the vertical extension of each female terminal 2' rises from the floor 4' of the female housing 1', the rising extension must be reduced with the reduction of connector's height until its resiliency is lowered, causing an adverse effect on the making of electric contact; (2) as each female terminal has a simple bending at the transient from the soldering tail to the vertical contact section, the distance L' between the opposite soldering tails 6' is reduced with reduction of connector's height accompanying reduction of lateral size so that it may be very difficult to arrange on a printed board, conductors apart enough to permit such conductors to be connected to the closest soldering tails; and (3) there are no recesses made on the bottom 7' of the housing 1' particularly in the vicinities of the transients 8' from the soldering tails 6' to the vertical contact sections 3', and therefore the soldering of the transients 8' of the female terminals 2' to conductors on the printed board is so difficult that there is a concern about incomplete soldering.

As for the male part, the vertical holding section 11' of the opposite male terminals 10' are press fitted in the opposite slots 12' of the center leg of the housing 9' of the male part, stressing the opposite slots 12' and potentially causing the undesired buckling of the male part housing apart from the female part housing. This tendency is liable to appear increasingly with the decrease of connector's height.

SUMMARY OF THE INVENTION

One object of the present invention is to provide an electric connector for use in coupling two printed boards, which electric connector structure meets the requirement of reduction of height, yet still assuring: first, a good resilient length of contact section in terminals; second, a good distance between the opposite soldering tails; third, no fear of permitting the rise of flux up to the terminal holding section at the time of soldering; fourth, a good solder joint at each soldering tail; fifth, no buckling of the male part housing apart from the female part housing; and sixth, reliable, high durability locking of the male and female parts.

To attain the object according to the present invention, an electric connector for use in coupling two printed boards comprising a male part having a plurality of pairs of male terminals longitudinally arranged and attached to its housing, and a female part having a plurality of pairs of female terminals longitudinally arranged and attached to its housing, the contacts of said male terminals being adapted to be put in contact with the corresponding contacts of said female terminals when said male and female parts are mated together, is improved in that: each of said female terminals is composed of a horizontal base, a contact beam rising from one end of said horizontal base and having a contact near its top end, a descent descending from the other end of said horizontal base, and a soldering tail horizontally extending from said descent, said female terminals being attached to the opposite side walls of the housing of the female part with their horizontal bases partly embedded in the opposite side walls, allowing their soldering tails to lie under the bottom of the housing, and at the same time, allowing their contact beams to be extended in the terminal accommodating space in which said male terminals are to be inserted when said male and female parts are mated together.

The bottom of the housing may have a recess made in the vicinity of the transient portion from the descent to soldering tail of each female terminal.

Each of said male terminals may be composed of a base, a contact beam rising from one end of said base and having a first catch at its top end, a second catch descending from the other end of said base, and a soldering tail horizontally extending from said second catch, said male terminals being attached to the opposite side walls of the housing of the male part with their first and second catches embedded in the top ends and floors of the opposite side walls, allowing their soldering tails to lie under the bottom of the housing, and at the same time, allowing their contact beams to extend in the terminal accommodating space defined in said female part when said male and female parts are mated together.

The bottom of the housing may have a recess made in the vicinity of the transient portion from the second catch to soldering tail of each male terminal.

The housing of said female part may have an elongated terminal mount in the space defined by its opposite side walls and opposite end walls, said elongated terminal mount having a latch member formed in the center of either opposite end wall, and the housing of said male part may have a catch member formed in the center of either opposite end wall, thereby permitting the housing of said female part and the housing of said male part to be locked when mated together.

With such arrangement as described above a good resilient length of contact section in each female terminal is assured by the resiliency provided by the horizontal base partly embedded in each side wall of the housing. Also, a good distance is assured between the opposite soldering tails because of additional horizontal base lengths. In addition, at the time of soldering there is no fear of permitting the rising of flux up to the terminal holding sections which are provided in the form of horizontal bases embedded in the opposite side walls because such terminal holding sections are not upright from the printed board as is the case with the conventional electric connector as shown in FIG. 19.

The soldering can be effected with ease thanks to the recess made on the housing bottom near each soldering tail-to-descent transient part of the female terminal.

No buckling of the male part housing can be caused because no stress appearing in the insert-molding of male terminals, different from the press-fitting of male terminals in the housing. Also, the soldering can be effected with ease thanks to the recess made on the housing bottom near each soldering tail-to-contact beam transient of the male terminal.

Finally, the reliable, high-durable jocking of the male and female parts is assured because the locks and provided inside, not exposed directly to undesired impacts from the outside.

BRIEF DESCRIPTION OF THE DRAWINGS

Other objects and advantages of the present invention will be understood from the following description of electric connectors according to preferred embodiments of the present invention, which embodiments are shown in accompanying drawings.

DESCRIPTION OF PREFERRED EMBODIMENT

Figure 1:
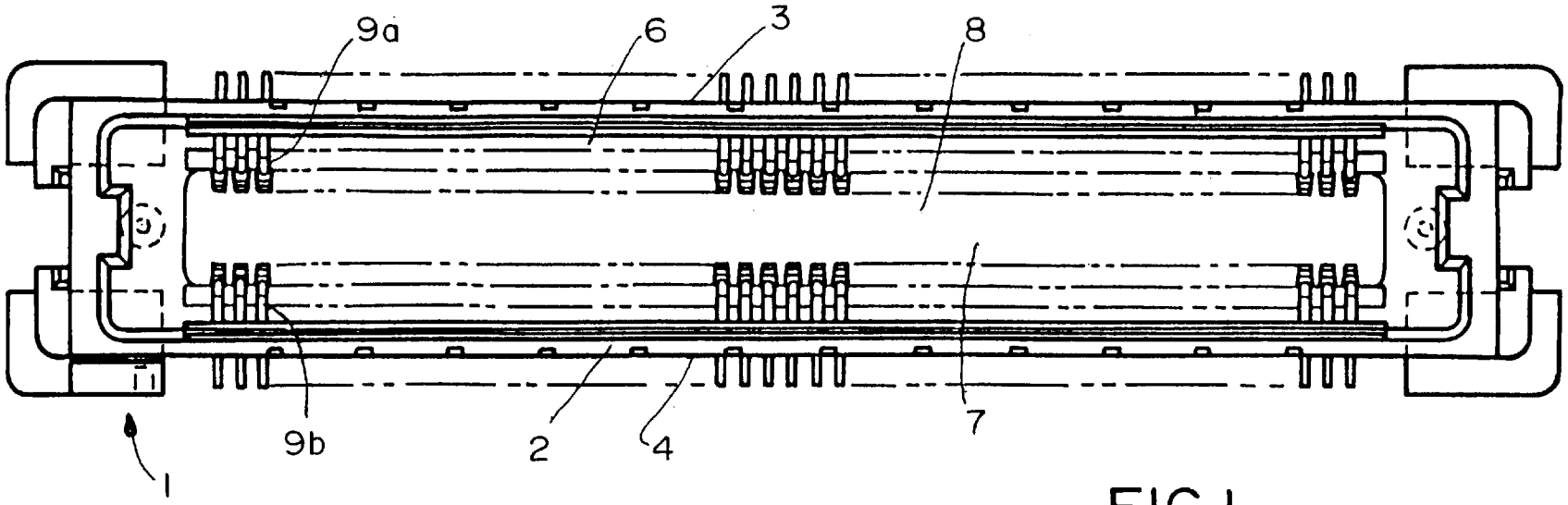
FIG. 1 is a plane view of a female part of an electric connector of a first embodiment of the present invention.

First, referring to FIGS. 1 to 4 and FIGS. 9 to 11, the female part 1 of an electric connector according to the first embodiment is described. The female part 1 has a housing 2 composed of opposite side walls 3 and 4, opposite end walls and a floor 5 together defining a space 6 to accommodate the contacts of the male part of the electric connector. The housing 2 has a center longitudinal projection 7, of which the top surface is used as a vacuum-sucking area 8 for pick and place purposes. The center section 7 is approximately the same height as the female terminals 9*a* and 9*b*.

Figure 2:
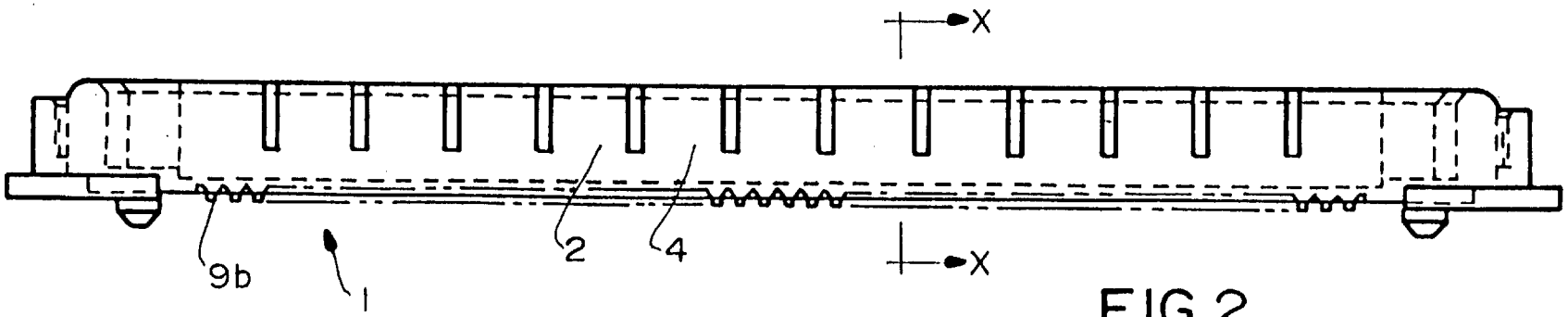
FIG. 2 is a right side view of the female part.
Figure 3:
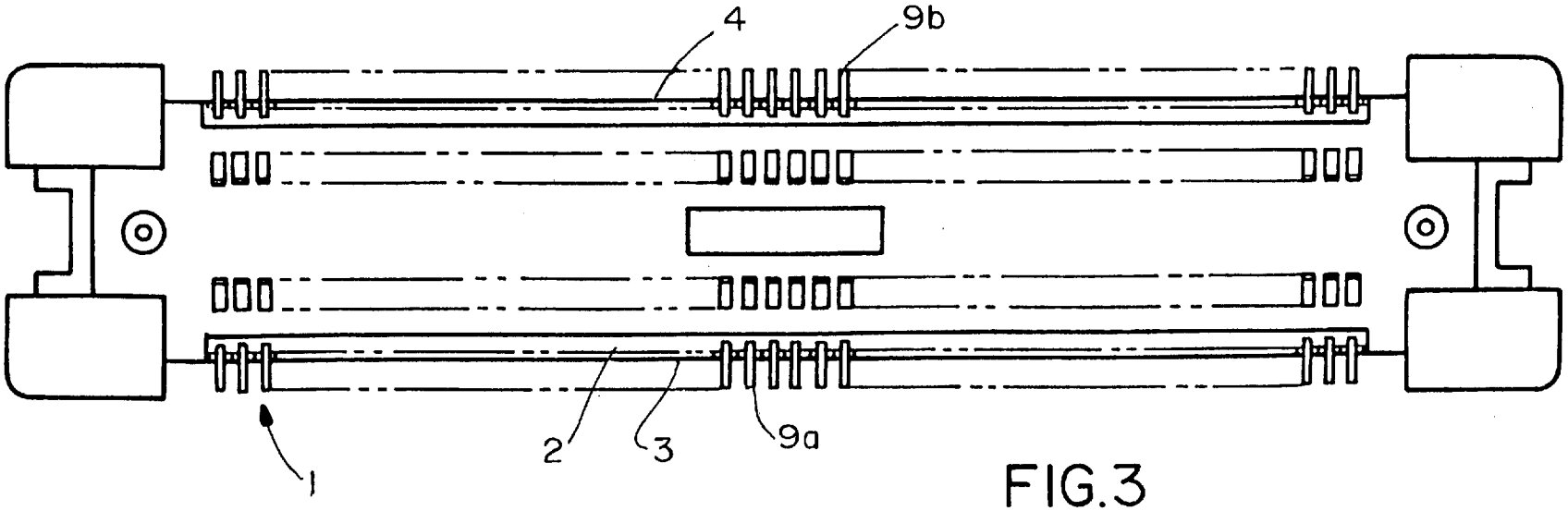
FIG. 3 is a bottom view of the female part.
Figure 4:
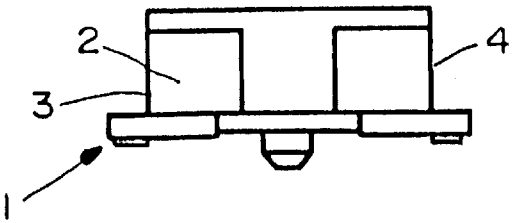
FIG. 4 is a front view of the female part.
Figure 5:
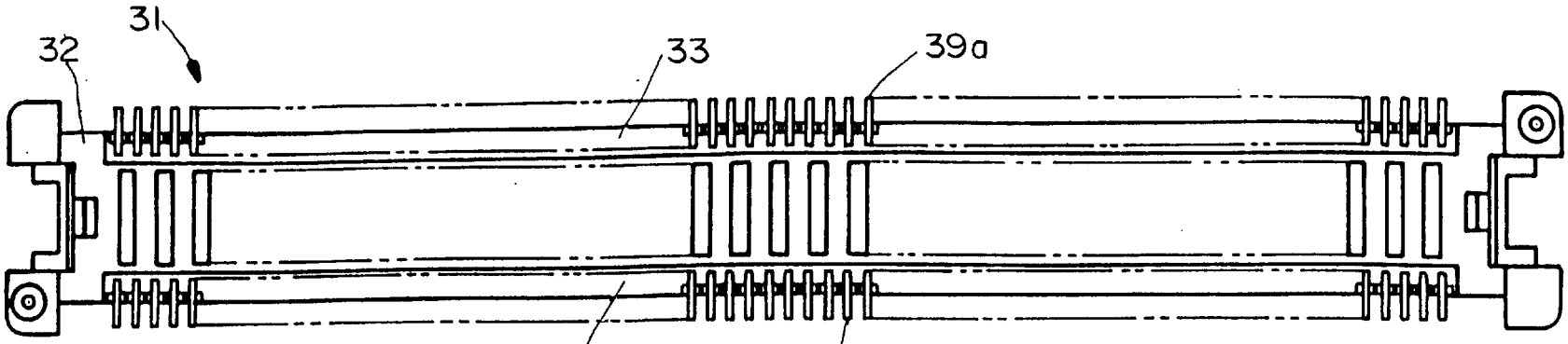
FIG. 5 is a plane view of a male part of the electric connector of the first embodiment of the present invention.
Figure 6:
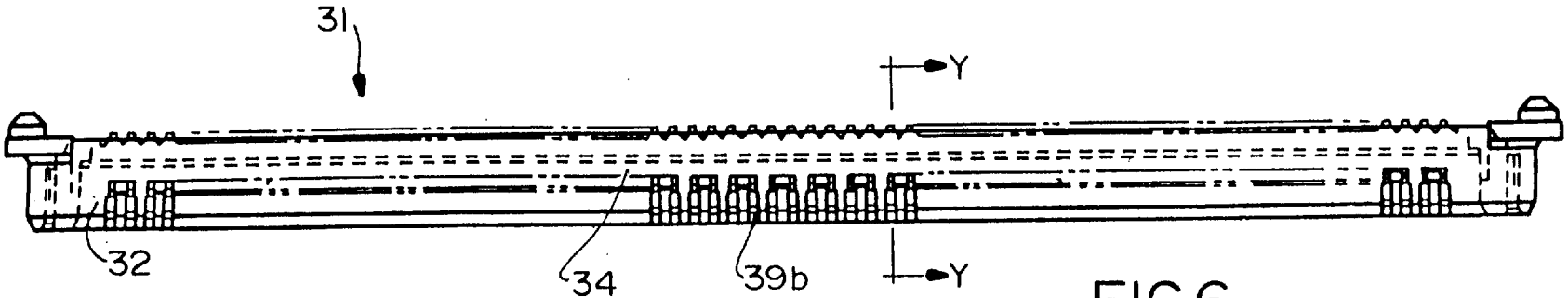
FIG. 6 is a right side view of the male part.
Figure 7:
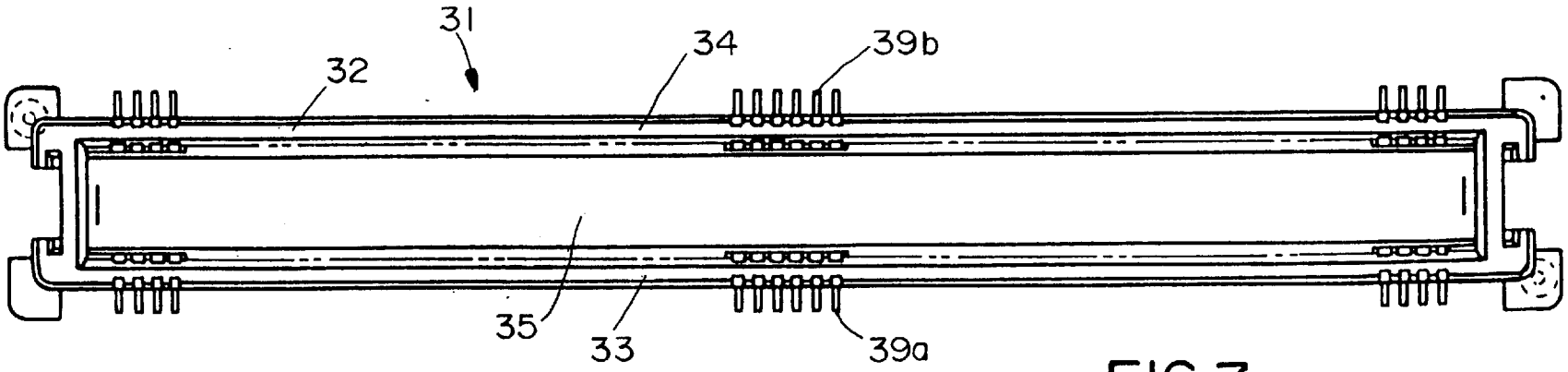
FIG. 7 is a bottom view of the male part.
Figure 8:
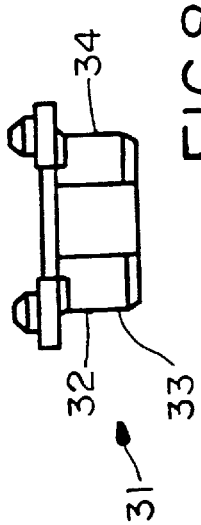
FIG. 8 is a front view of the male part.

As seen from FIGS. 1 to 3, a plurality of pairs of stamped and formed female terminals 9*a* (on left side) and 9*b* (on right side) are longitudinally arranged at regular intervals in the housing 2. A pair of female terminals are symmetrical in shape, and therefore, only one female terminal 9*b* is described with reference to FIG. 10.

Each female terminal is composed of a horizontal base 10, a contact beam 13 rising from one end 11 of the horizontal base 10 and having a curved contact 12 near its top end, an angled descent 15 descending from the other end of the horizontal base 10, and a soldering tail 16 horizontally extending from the descent 15.

Such female terminals 9*a*, 9*b* are attached to the opposite side walls 3 and 4 of the housing 2 of the female part 1 with their horizontal bases 10 embedded partly (as indicated at 10*a*) in the opposite side walls 3 and 4 as for instance by insert molding allowing their soldering tails 16 to lie below the bottom 18 of the housing 2, and at the same time, allowing their curved contact beams 13 to be extended in the terminal accommodating space 6 in which the male terminals 39*a*, 39*b* are to be inserted when the male and female parts 31 and 1 are mated together. As seen from FIG. 9, the exposed portion 10*a* of each horizontal base 10 is laid on the floor 5. A triangular portion 3' and 4' of each sidewall extends into space 6 towards projection 7 to help secure the terminal in place.

The bottom 18 of the housing 2 has a recess 19 made near the transient portion 17 from the descent 15 to the soldering tail 16 of each female terminal 9*a* or 9*b*. A hole 18' is provided to permit the deflectable portion 10*b* of horizontal base 10 to deflect and to allow the terminal to be supported during the overmolding process used to manufacture the connector.

Next, referring to FIGS. 5 to 8 and FIG. 12, the male part 31 of the electric connector according to the first embodiment is described. The male part 31 has a housing 32 composed of opposite side walls 33 and 34, opposite end walls and a floor 35, together defining a space 36 to accommodate the contact beams of the female part of the electric connector. The floor 35 is sufficiently smooth to permit it to be used as a vacuum sucking area for pick and place purposes.

As seen from FIG. 5 to 8, a plurality of pairs of male terminals 39*a* (on left side) and 39*b* (on right side) are longitudinally arranged at regular intervals in the housing 32. A pair of male terminals are symmetrical in shape, and therefore, only one male terminal 39*a* is described with reference to FIG. 12.

Each male terminal is composed of a base 40, a contact beam 43 extending from one end 41 of the base 40 and having a first catch 42 at one end, a second catch 45 descending from the other end of the base 40, and a soldering tail 46 horizontally extending from the second catch 45. The exposed surface of the contact beam 43 provides a contact section 48.

The male terminals 39*a*, 39*b* are attached to the opposite side walls 33 and 34 of the housing 32 of the male part with their first and second catches 42 and 45 embedded in the top ends and floors 35, respectively, of the opposite side walls 33 and 34 as for instance by insert molding, allowing their soldering tails 46 to lie under the bottom 49 of the housing 32, and at the same time, allowing their contact beams 43 to extend in the terminal accommodating space 36 defined in the female part 1 when the male and female parts 31 and 1 are mated together. As seen from FIG. 12, each contact beam 43 extends along side wall 33 or 34, permitting its exposed surface to be used as contact. The bottom 49 of the housing 32 has a recess 50 made near the transient portion 51 from the second catch to the soldering tail 46 of each male terminal 39*a* or 39*b*.

The manner in which such electric connector is used is described below. First, the female part 1 is attached to one printed board 21 by soldering the soldering tails 16 of the female terminals 9*a* and 9*b* to selected conductors of one printed board 21.

Figure 9:
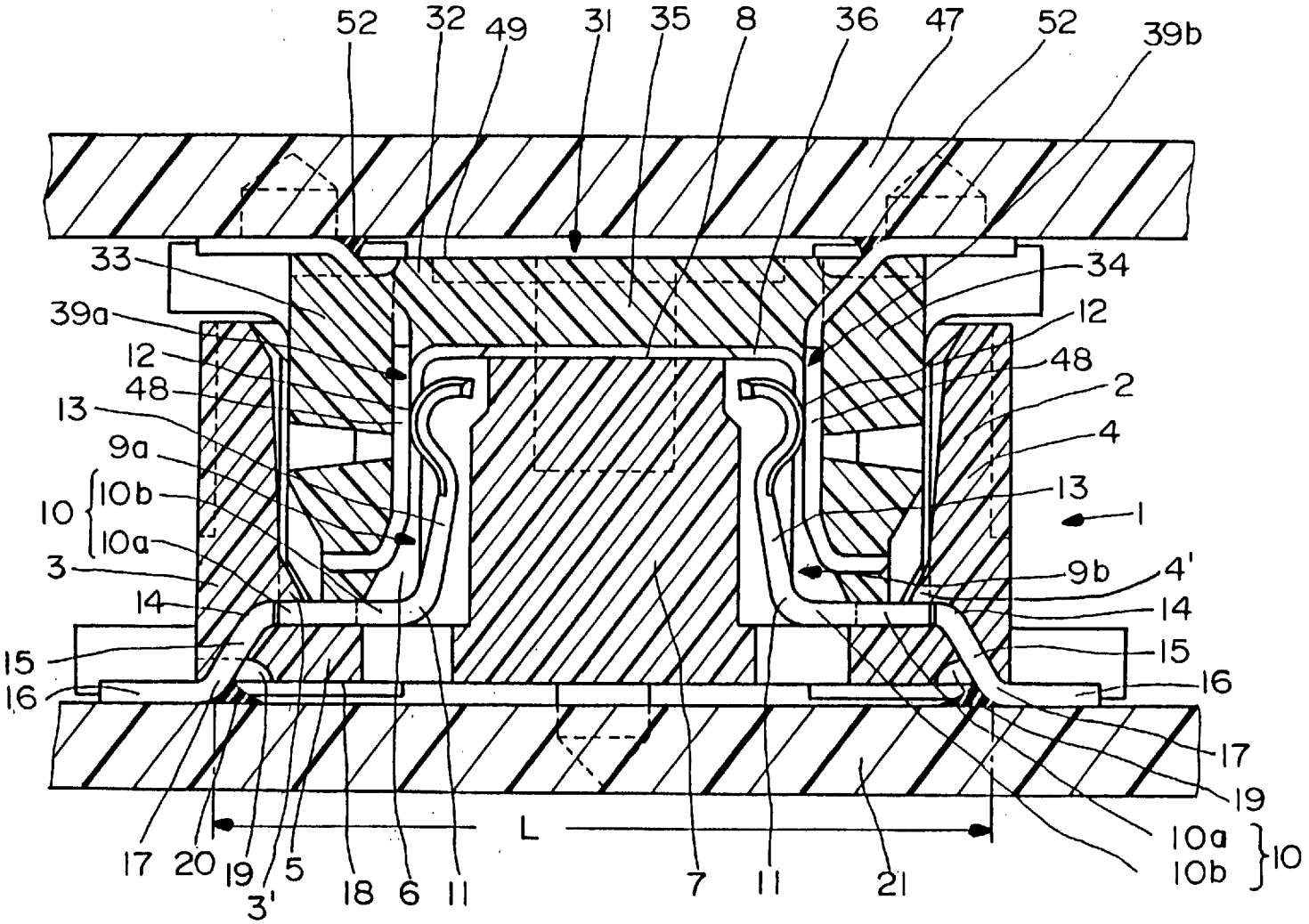
FIG. 9 is a cross section taken along the line X—X in FIG. 2 and along the line Y—Y in FIG. 6, showing the manner in which the male and female parts are mated together.
Figure 10:
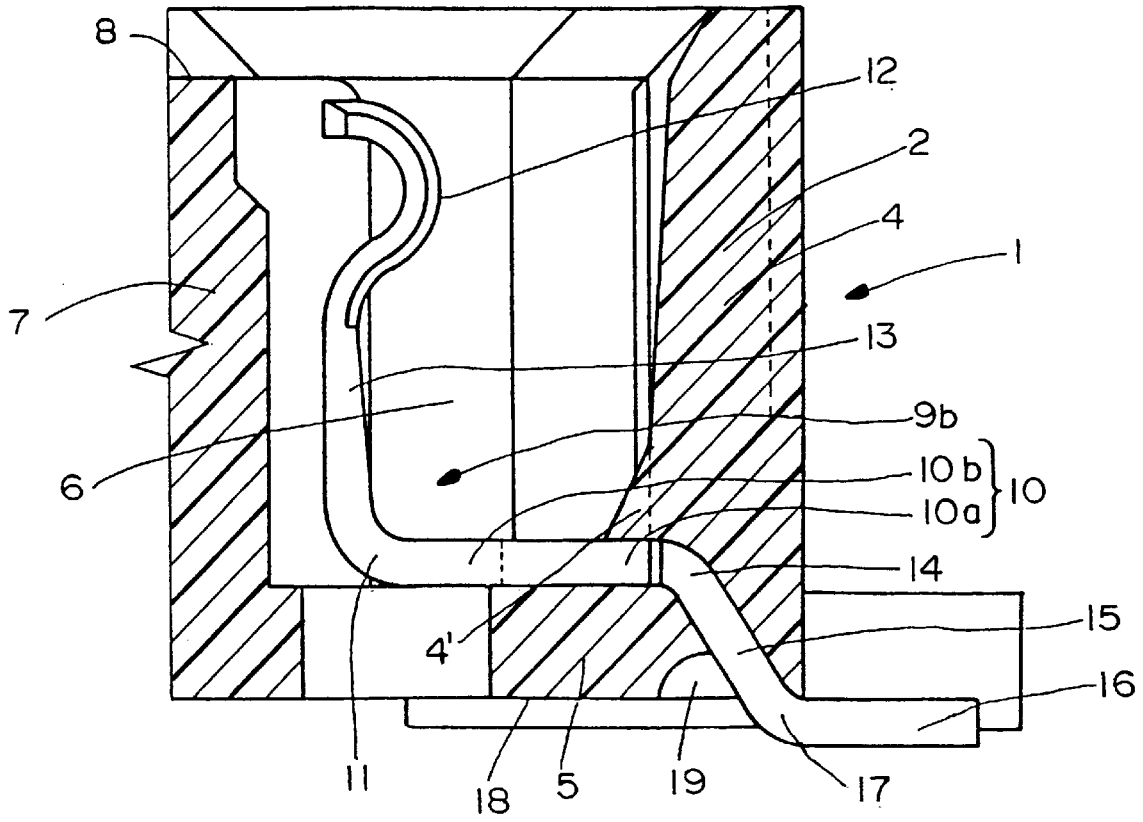
FIG. 10 is an enlarged section showing a female terminal fixed to the housing of the female part.
Figure 11:
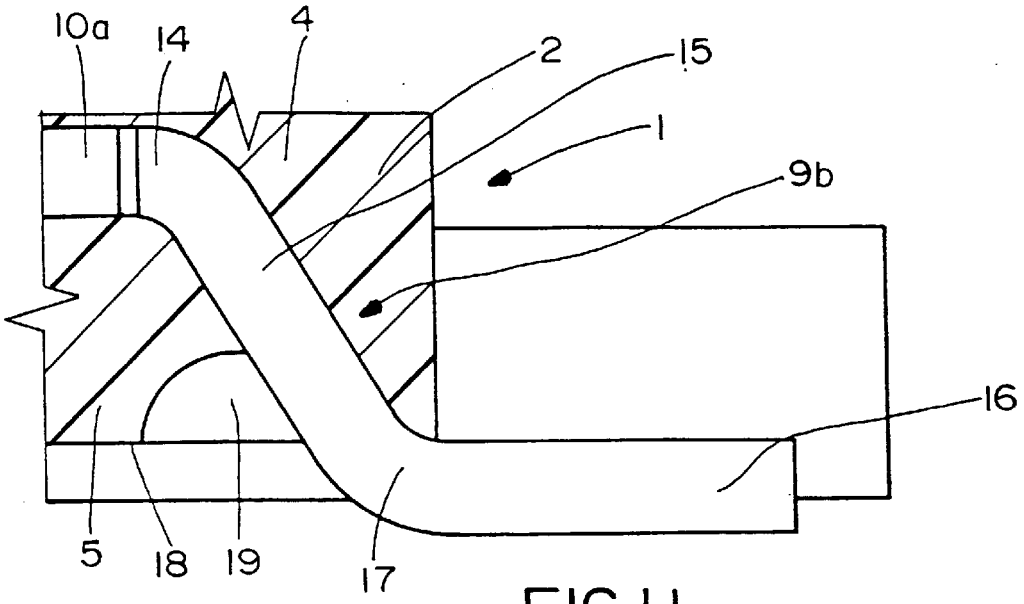
FIG. 11 is an enlarged section of a recess made in the bottom of the housing of the female part.
Figure 15:
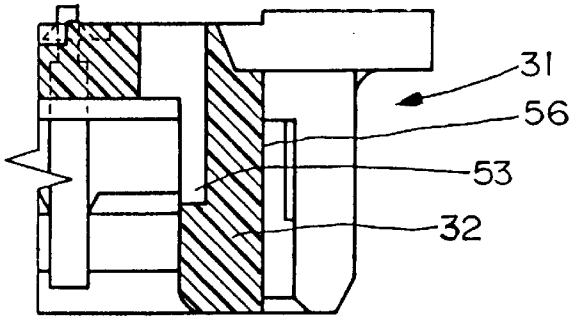
FIG. 15 is a section taken along the line Z—Z in FIG. 14.
Figure 19:
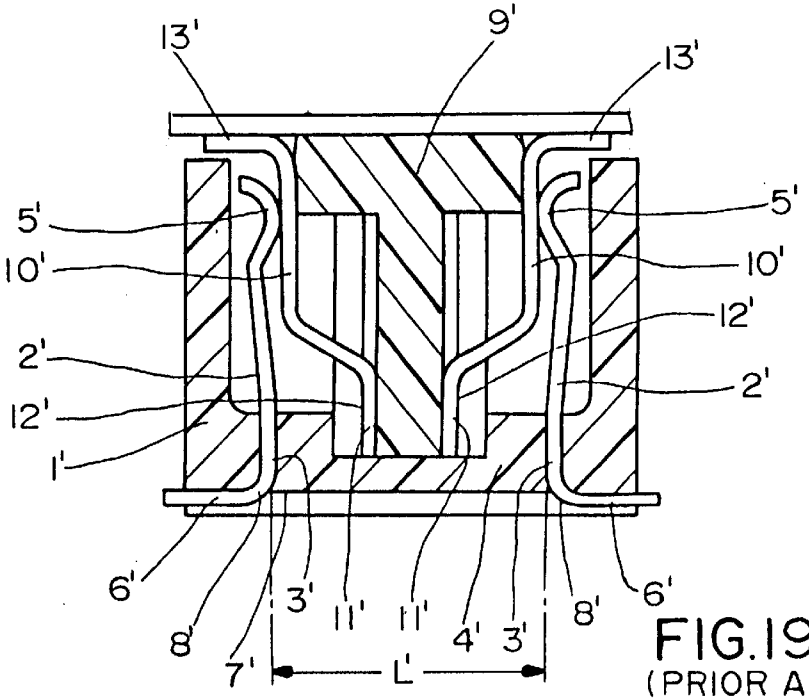
FIG.19 (PRIOR ART)
FIG. 19 is a cross section showing a conventional electric connector.
Figure 12:
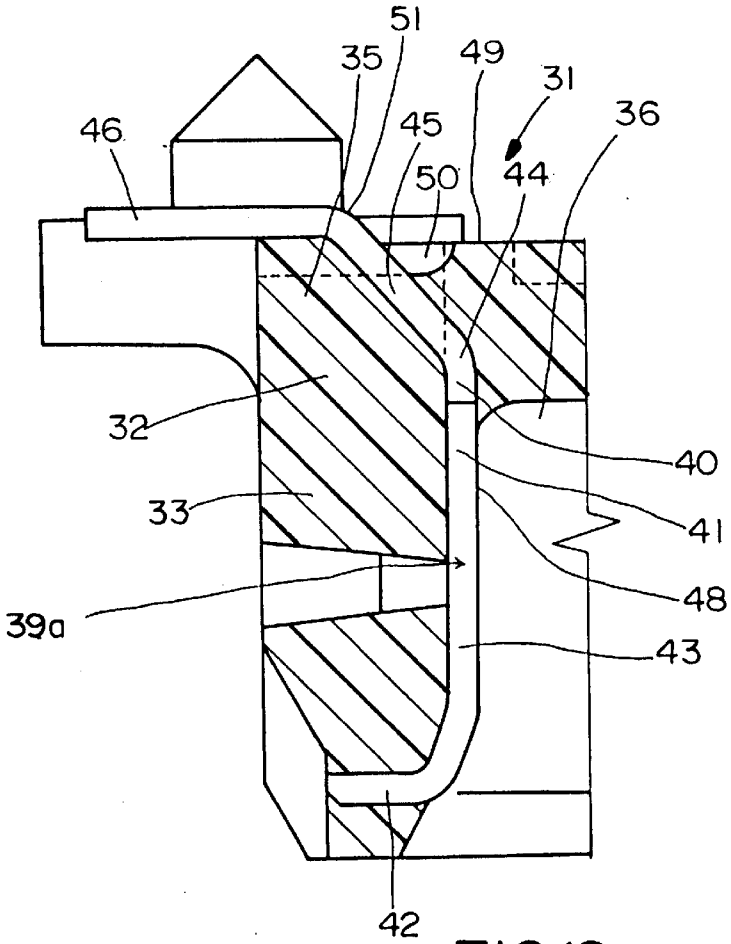
FIG. 12 is an enlarged section showing a male terminal fixed to the housing of the male part.

As seen from FIG. 9, the soldering tails 16 of the opposite female terminals 9*a* and 9*b* are separated a relatively long distance 1, thanks to the extra lengths of horizontal bases 10 regardless of the reduction of connector height, thus permitting selected conductors on the printed board to be soldered to the soldering tails 16 with ease.

As indicated at 20 in FIG. 9, the soldering is effected to the soldering tail-to-descent transient 17 at the recess 19, which facilitates the precision soldering to selected conductors on the printed board.

On the other hand the male part 31 is attached to the other printed board 47 by making use of the recesses 50 on the bottom 49 of the housing 35 to solder the soldering tail to second catch transients 51 of the male terminals 39*a* and 39*b* to selected conductors of the other printed board 47 with ease and high precision. When the male and female parts are mated together, the contact sections 48 of the opposite male terminals 39*a* and 39*b* contact the curved contacts 12 of the opposite female terminals 9*a* and 9*b* to make the required electric connections. Even if the contact beams 13 of the opposite female terminals 9*a* and 9*b* are reduced with reduction of connector's heights, the lengths 10*b* of the horizontal bases 10 function as resilient means, thereby adding extra resilience to the shortened contact beams 13 of the opposite female terminals 9*a* and 9*b* to assure the sufficient effective length of resilience to permit application of the curved contacts 12 against the contact beams 4 with required contact pressure independent of reduction of connector's height.

Figure 13:
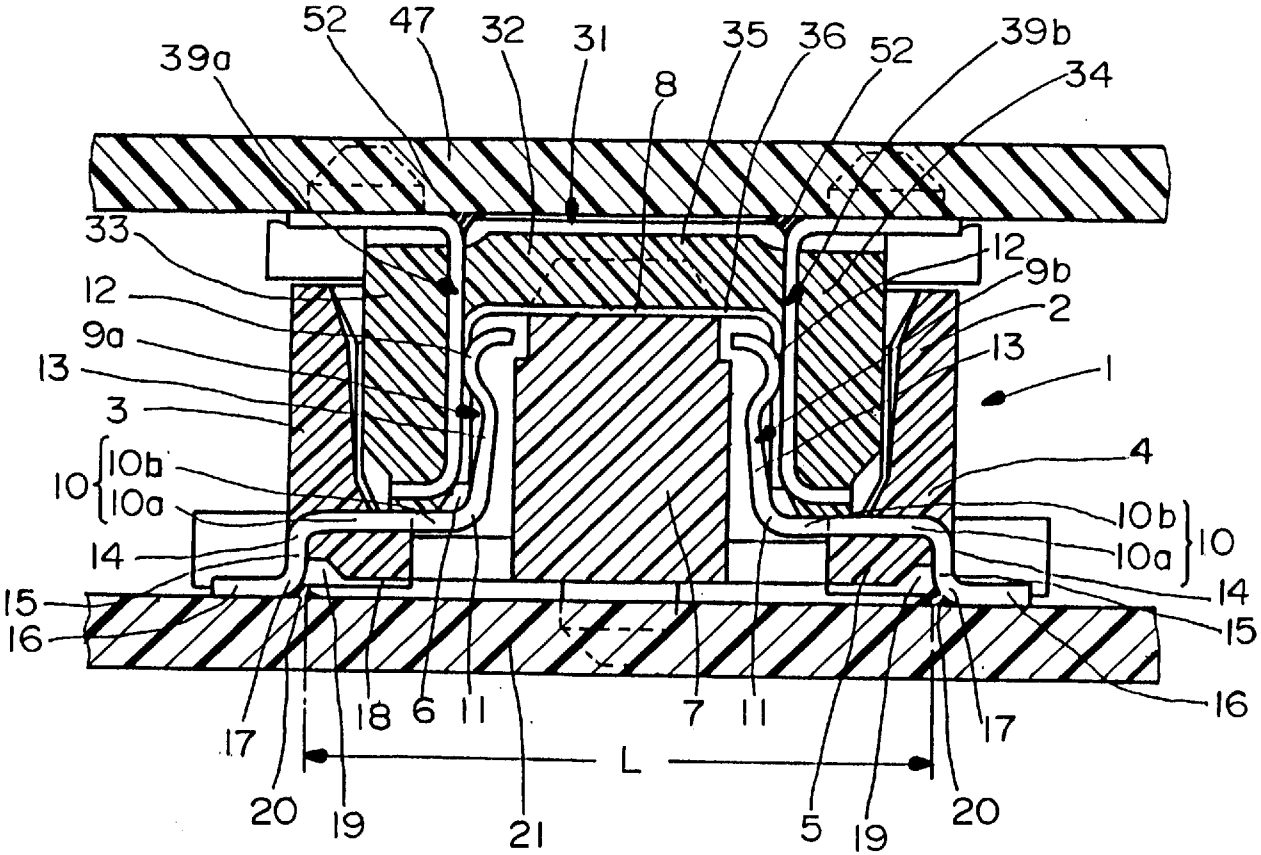
FIG. 13 is a cross section similar to FIG. 9, but showing the manner in which the male and female parts of an electric connector according to a second embodiment of the present invention are mated together.
Figure 14:
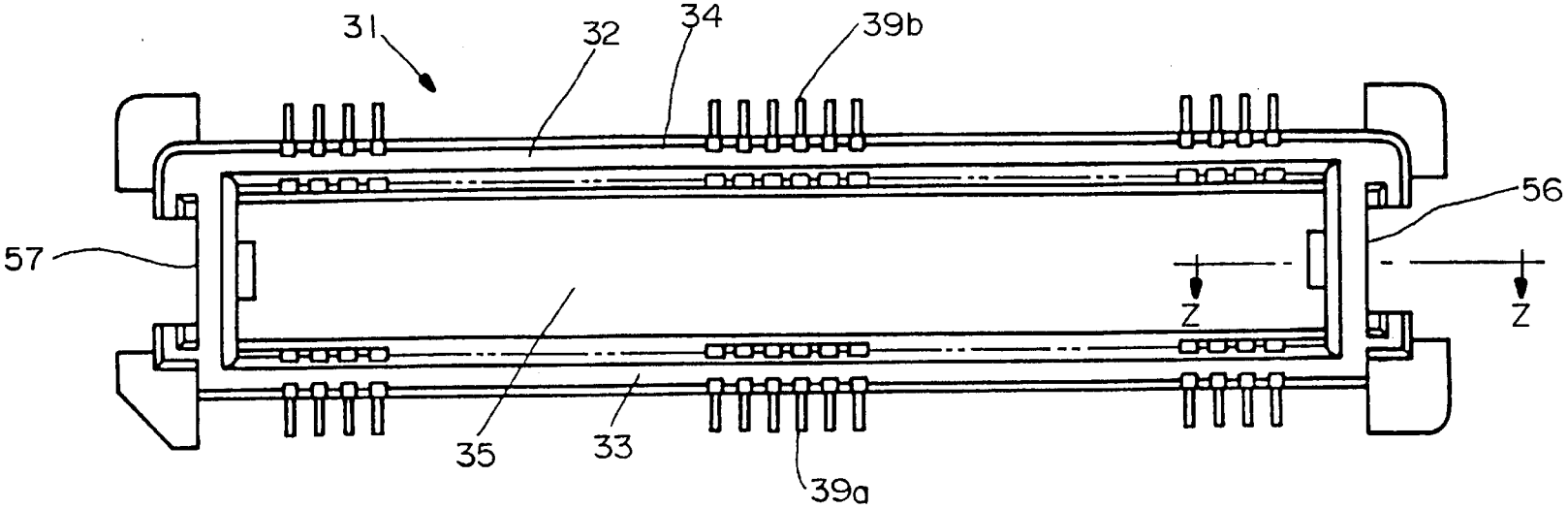
FIG. 14 is a bottom view of a male part of an electric connector according to a third embodiment of the present invention.
Figure 16:
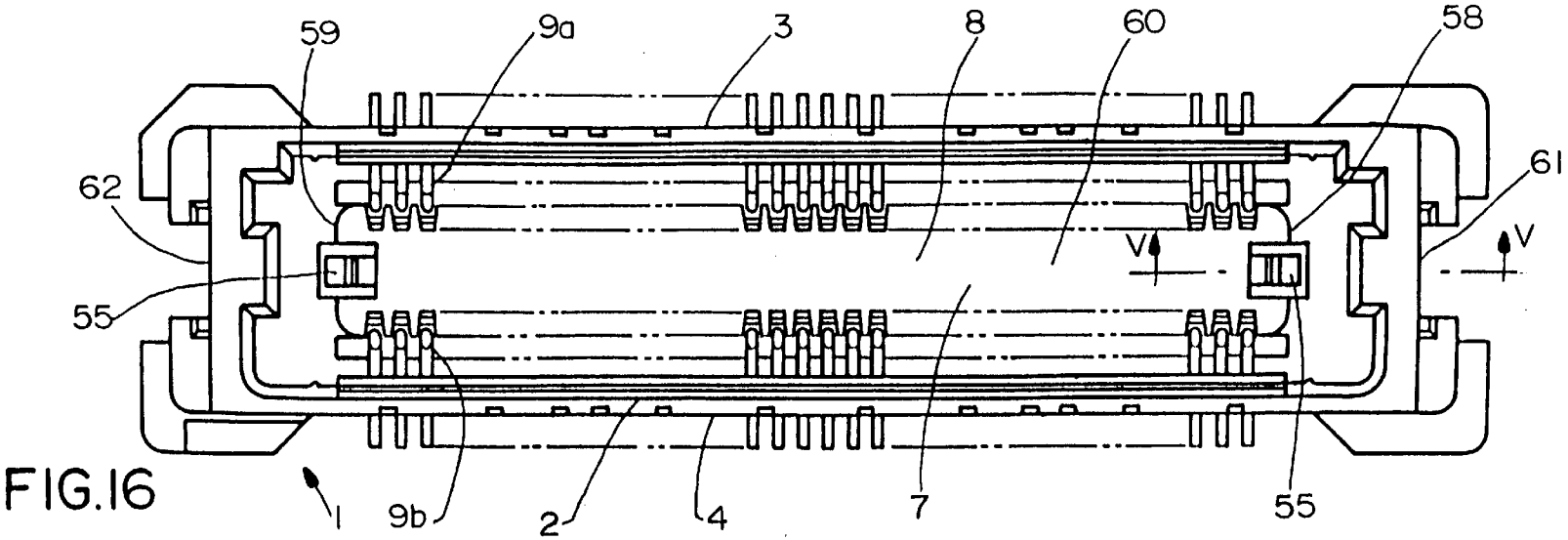
FIG. 16 is a plan view of a female part of an electric connector according to a fourth embodiment of the present invention.
Figure 17:
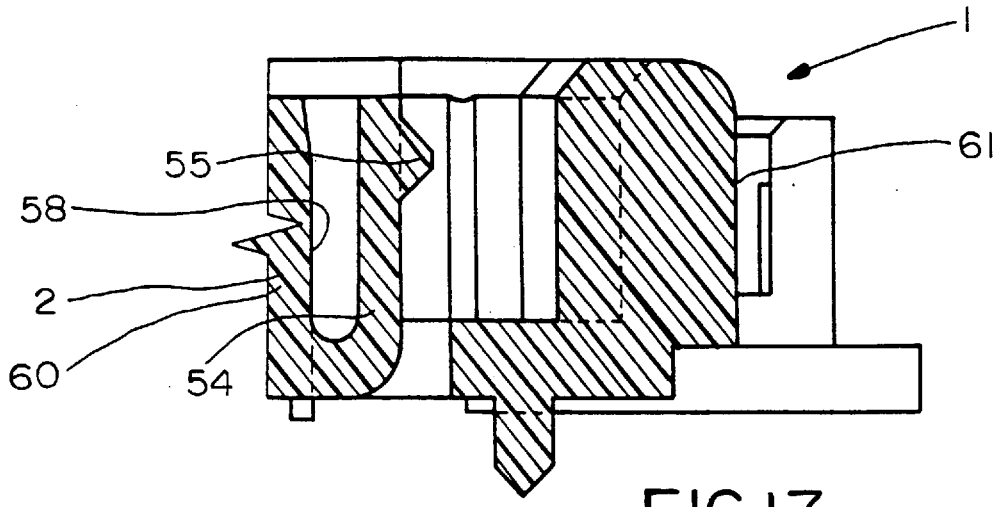
FIG. 17 is a section taken along the line V—V in FIG. 16.
Figure 18:
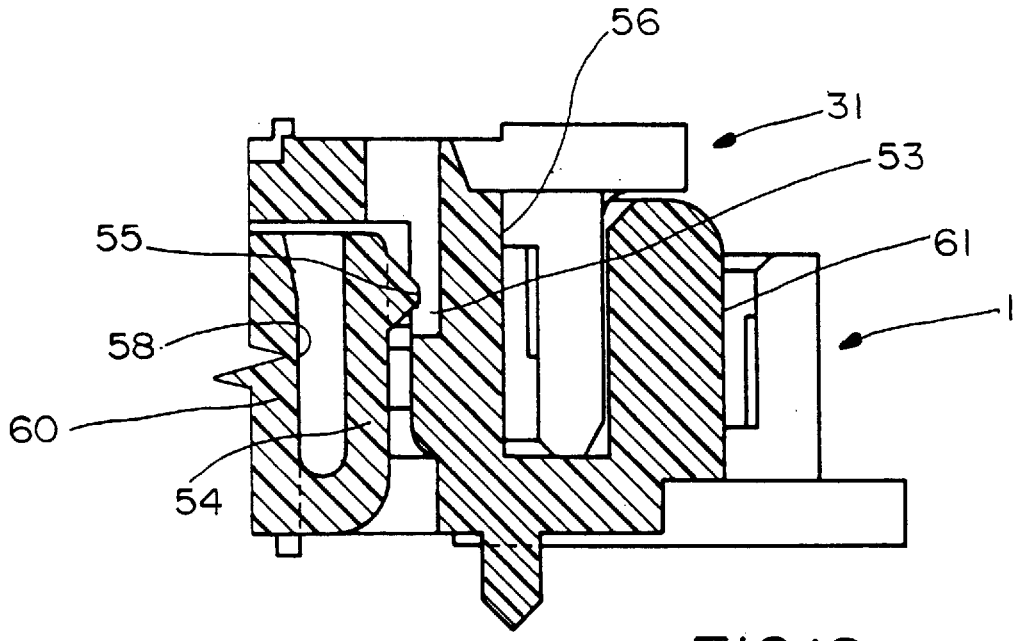
FIG. 18 is a section partly showing the mating of the female part of FIG. 16 and the male part of FIG. 14.

FIG. 13 shows an electric connector according to another embodiment, which is different from the electric connector of FIG. 9 only in that the descents 15 stand upright. The so modified electric connector can attain same function and advantage as the electric connector of FIG. 9.

Finally, referring to FIGS. 14 to 18, the locking of the male and female parts is described below. The housing 2 of the female part 1 has an elongated terminal mount 60 in the space defined by its opposite side walls 3 and 4 and opposite end walls 61 and 62, as seen from FIGS. 16 and 17. The elongated terminal mount 60 has a plurality of female terminals 9*a* and 9*b*, and the terminal mount has a latch member 55 formed in the center of either or both of opposite end walls 58 and 59. The latch member 55 projects from the free end of resilient J-shaped arm 54 integrally connected to the lower part of the end wall 58, as seen from FIG. 17. As seen from FIGS. 14 and 15, the housing 32 of the male part 31 has a catch member 53 formed in the inside, center of either or both of opposite end walls 56 and 57. In this particular example, the catch member 53 is made in the form of slot. Thus, the housing 2 of the female part 1 and the housing 32 of the male part 1 are locked to each other when mated together.

Specifically, when the male part housing 32 is inserted in the female part housing 2, the latch members 55 of the opposite end walls 58 and 59 of the terminal mount 60 of the female part housing 2 fit in the slots 53 on the inside surfaces of the opposite end walls 56 and 57 of the male part housing 32, thereby locking the male part to the female part. The locking is effected inside, and therefore, is insensitive to undesired impacts from the exterior, and accordingly the locking parts are durable.

It will be appreciated by those skilled in the art that the embodiments of the present invention disclosed herein are merely illustrative of some of the applications of this invention and that numerous modifications may be made by those skilled in the art without departing from the true spirit and scope of this invention.

I claim:

1. An electrical connector for mating with a complementary mating electrical connector, said electrical connector comprising:

a dielectric housing;

a plurality of terminals mounted therein;

each said terminal having a contact beam extending in a first direction with a contact area for contacting a mating terminal of said complementary mating electrical connector, portions at opposite ends of said contact beam embedded in and retained by said housing, and a tail portion extending from one of said embedded portions for interconnecting said terminal to an electrical circuit of a circuit member upon which said electrical connector is adapted to be mounted.

2. The electrical connector as set forth in claim 1 wherein said embedded end portions of each terminal extend at angles with respect to the contact beam.

3. The electrical connector as set forth in claim 1 in which at least one of said embedded end portions of each terminal extends substantially at a right angle to the contact beam.

4. The electrical connector of claim 1 in which at least one of said embedded end portions of each terminal extends at an acute angle to a plane containing said contact beam.

5. The electrical connector as set forth in claim 1 in which the end portion of each terminal from which the tail portion extends is disposed at an acute angle to a plane containing said contact beam.

6. The electrical connector as set forth in claim 5 in which the other end portion of each terminal extends substantially at a right angle to the contact beam.

7. The electrical connector as set forth in claim 1 in which the tail portion of each terminal is substantially parallel to the end portion of the contact beam opposite the end portion from which the tail portion extends.

8. The electrical connector as set forth in claim 1 in which said dielectric housing includes a pair of spaced apart generally parallel side walls, said terminals each being supported by said housing with the contact beam thereof mounted adjacent one of said side walls.

9. The electrical connector as set forth in claim 8 in which said connector housing side walls define an opening to accommodate a portion of said complementary electrical connector, and said terminals each are mounted in said dielectric housing with the contact beam thereof disposed within said opening.

10. The electrical connector as set forth in claim 8 in which said dielectric housing has a base interconnecting said side walls, said terminal tail portion of each terminal being mounted adjacent said base, and said base being formed with a recess adjacent a junction between the tail portion of each terminal and the embedded end portion from which it extends.

11. An electrical connector assembly for use in coupling two circuit members comprising a first connector part having a plurality of pairs of first terminals longitudinally arranged and mounted in a first housing; a second connector part having a plurality of pairs of second terminals different from said first terminals longitudinally arranged and mounted in a second housing; each said first terminals having a contact beam extending in a first direction with a contact area for contacting a second terminal of said second connector part, portions at opposite ends of said contact beam embedded in and retained by said first housing, and a tail portion extending from one of said embedded portions for interconnecting the first terminal to one of said circuit members.

12. The electrical connector assembly as set forth in claim 11 wherein said embedded end portions of each first terminal extend at angles with respect to the contact beam of the terminal.

13. The electrical connector assembly as set forth in claim 11 in which at least one of said embedded end portions of each first terminal extends substantially at a right angle to the contact beam of the terminal.

14. The electrical connector assembly as set forth in claim 11 in which at least one of said embedded end portions of each first terminal extends at an acute angle to a plane containing the contact beam of the terminal.

15. The electrical connector assembly as set forth in claim 11 in which the tail portion of each first terminal is substantially parallel to the end portion of the contact beam opposite the end portion from which the tail portion extends.

16. The electrical connector assembly as set forth in claim 11 in which said first housing includes a pair of spaced apart generally parallel side walls, said first terminals each being supported by said housing with the contact beam thereof mounted adjacent one of said side walls.

17. The electrical connector assembly as set forth in claim 16 in which said first housing side walls define an opening to accommodate the second terminals of said second connector port, and said first terminals each are mounted in said first housing with the contact beam thereof disposed within said opening.

18. The electrical connector assembly as set forth in claim 11 in which said first housing includes a pair of spaced apart side walls adjacent which the contact beams of said first terminals are disposed, and said second housing includes a pair of spaced apart side wall between which the contact beams of said second terminals are disposed, and said connector parts being interengageable with the side walls of said first housing being disposed between the side walls of said second housing.

19. The electrical connector assembly as set forth in claim 18 in which said connector parts are interengageable with the contact beams of said second terminals disposed between and engageable with the contact beams of said first terminals.

20. The electrical connector assembly as set forth in claim 11 in which each said second terminal has a cantilevered contact beam extending in a first direction which has a free end and an opposite end, said contact beam having a contact area adjacent said free end for contacting the contact area of one of said first terminals, a base portion at said opposite end generally transverse to the contact beam of the terminal, at least a portion of said base portion being embedded within and supported by said second housing, a tail portion for interconnecting said second terminal to the other of said circuit members, and a transition portion extending at an angle between and interconnecting said tail portion and base portion of the terminal.

21. The electrical connector assembly as set forth in claim 20 wherein said base portion of each second terminal extends substantially perpendicularly from the contact beam thereof.

22. The electrical connector assembly as set forth in claim 20 in which the base portion of each second terminal is horizontally disposed and the transition portion thereof extends at an acute angle to the horizontal.

23. The electrical connector assembly as set forth in claim 20 in which said transition portion of each second terminal extends perpendicularly to the base portion thereof.

24. The electrical connector assembly as set forth in claim 20 in which the base portion and tail portion of each second terminal are parallel to each other.

25. An electrical connector for mating with a complementary mating electrical connector, said electrical connector comprising:

a dielectric housing;

a pair of rows of terminals mounted therein;

each said terminal having a contact beam extending in a first direction, a contact area for contacting a mating terminal of said complementary mating electrical connector, portions at opposite ends of said contact beam embedded and retained by said housing, and a tail portion extending from one of said embedded portions for interconnecting said terminal to an electrical circuit of the circuit member upon which said electrical connector is adapted to be mounted; and contact areas of the terminals in each of said pair of rows of terminals opposing contact areas of terminals in the other of said pair of rows of terminals.

* * * * *